US006523440B2

(12) United States Patent
Friedman et al.

(10) Patent No.: US 6,523,440 B2
(45) Date of Patent: Feb. 25, 2003

(54) COMPRESSION STOP AND COUPLING WRENCH

(75) Inventors: David F. Friedman, McHenry, IL (US); Harry C. Friedman, McHenry, IL (US)

(73) Assignee: Ridge Teel Company, Elyria, OH (US)

( * ) Notice: Subject to any disclaimer, the term of this patent is extended or adjusted under 35 U.S.C. 154(b) by 0 days.

(21) Appl. No.: 09/523,031

(22) Filed: Mar. 10, 2000

(65) Prior Publication Data

US 2002/0062719 A1 May 30, 2002

Related U.S. Application Data

(60) Provisional application No. 60/143,347, filed on Jul. 12, 1999.

(51) Int. Cl.[7] ..... B25B 13/00
(52) U.S. Cl. ..... 81/125.1; 81/119; 81/186
(58) Field of Search ..... 81/125.1, 119, 81/186, 177.4

(56) References Cited

U.S. PATENT DOCUMENTS

| | | | | | |
|---|---|---|---|---|---|
| 342,824 | A | | 6/1886 | Clark | |
| 529,707 | A | * | 11/1894 | Clay | 81/119 |
| 759,948 | A | * | 5/1904 | Weston | 81/125.1 |
| 798,325 | A | | 8/1905 | Daddysman | |
| 1,250,328 | A | | 12/1917 | Langford | |
| 1,338,278 | A | | 4/1920 | Blum | |
| 2,466,884 | A | | 4/1949 | English et al. | |
| D167,245 | S | * | 7/1952 | Anderson | 81/119 |
| 3,424,039 | A | | 1/1969 | Scott | |
| 3,905,255 | A | * | 9/1975 | Evans | 81/119 |
| 5,230,263 | A | * | 7/1993 | Kwaka | 81/125.1 |
| 5,442,982 | A | | 8/1995 | Bell | |
| 5,492,040 | A | * | 2/1996 | Bellas | 81/125.1 |
| 5,577,426 | A | * | 11/1996 | Eggert et al. | 81/125 |
| 5,953,968 | A | * | 9/1999 | Macor | 81/119 |
| 6,009,779 | A | * | 1/2000 | Mastroni | 81/177.2 |
| 6,016,728 | A | * | 1/2000 | Bohl | 7/139 |
| 6,182,541 | B1 | * | 2/2001 | Anderson et al. | 7/118 |
| 6,405,396 | B1 | * | 6/2002 | Tsai | 7/165 |

* cited by examiner

*Primary Examiner*—James G. Smith
*Assistant Examiner*—Hadi Shakeri
(74) *Attorney, Agent, or Firm*—Fay, Sharpe, Fagan, Minnich & McKee

(57) ABSTRACT

The present invention is an apparatus to facilitate the installation and replacement of mechanical devices, particularly plumbing compression fittings such as an angle-stop valve. The wrench has a first member that includes an open-end wrench and associated jaw surface and a hollow handle extending therefrom. A second member also includes an open-end wrench and a handle extending therefrom, the handle of the second member being of a diameter small enough to slidably fit within the handle of the first member. The handles of the first and second members preferably including mating means so as to enable the temporary locking of the two members for use and or storage of the two-piece wrench apparatus. The handle of the second member further includes a lug extending therefrom and having a certain size and shape so as to allow the lug end of the wrench to engage an inner diameter of the angle-stop valve during its installation.

13 Claims, 4 Drawing Sheets

COMPRESSION STOP AND COUPLING WRENCH

This application claims the benefit of prior filed copending provisional application 60/143,347, filed Jul. 12, 1999, entitled: COMPRESSION STOP AND COUPLING WRENCH.

This invention relates generally to an apparatus employed in the plumbing trades, and more particularly to a two-piece tool that is employed in the installation of compression valves or stops and their associated compression couplings, whereby the installer needs only the single tool.

BACKGROUND AND SUMMARY OF THE INVENTION

There exists in the plumbing industry a widely used fitting known as a compression stop or a compression stop valve, or more particularly as a ⅝"×⅜" (or alternatively ⅝"×½") compression straight or angle-stop valve. For many years, such fittings were attached to plumbing systems by soldering the fitting or via an internally threaded opening, being screwed onto threaded male nipples that were part of the domestic water plumbing systems. Angle-stops were eventually introduced with compression-type fittings so as to eliminate the need to solder or screw the threaded male nipples at water outlets. The "compression" stop is now a predominant means for terminating plumbing water supply at locations near plumbing fixtures such as faucets, toilets, etc. The compression stops provide an easy method to control the water supply without shutting down the entire system, in the event that the associated fixture needs repair or replacement.

Typically, angle-stops and similar compression fittings are installed using one of two tooling approaches. The most common method is for a plumber or do-it-yourselfer to use two or three adjustable wrenches (e.g., Crescent™ wrenches). However, this method tends to be cumbersome and time consuming because there is a constant need to re-adjust the wrenches to fit the different dimensioned surfaces and compression nuts associated with the compression stops. Similarly, the adjustable wrenches are often of a size that prohibits their use in cramped surroundings such as within a sink or lavatory vanity cabinet. A second method, often used by those with more experience in the installation of compression stops, employs automotive-style open-end wrenches that are of fixed sizes necessary to accommodate all the surfaces of a compression stop. Unfortunately, the latter approach often requires as many as four different wrenches. These wrenches, like the adjustable wrenches, are made for heavy-duty use, where a user needs to apply significant torque to a nut or bolt (e.g., automotive applications). Thus, they too are generally longer and more heavily constructed than is necessary for the installation of compression stops. Lastly, the automotive-style open-end wrenches, and the adjustable wrenches, are often constructed with an angled offset between the wrench head and the handle that may complicate the alignment of a compression stop with the tubing riser to the faucet to which it is to be connected.

Experience suggests that both methods are tedious and time consuming when the described tools are used respectively, and in confined areas. Furthermore it is often too dark or otherwise difficult to obtain an accurate view of the final fixed angle of the compression stop and its angular relationship to the supply tubing from the associated faucet. A compression joint requires precise alignment and when such connections are significantly mis-aligned they require disassembly and readjustment. Due to the built-in angle of these automotive, or adjustable wrenches, the installer experiences a constant need to "roll" or rotate the wrench 180 degrees around its axis in order to approach the compression nut, at a different angle to facilitate movement of the wrench handle far enough to avoid obstacles while exerting the necessary wrenching force on the compression nut.

In order to alleviate the afore-described difficulties with the installation of compression and angle-stop devices, and their associated faucet supply tubes; the present invention is a two-piece apparatus that enables the user to completely install a compression stop plumbing fitting, or similar mechanical device without the need for additional tools. Moreover, various features of the present invention facilitate the installation of such fittings in areas that are difficult to access.

Heretofore, a number of patents have disclosed wrenches associated with angle-stops, the relevant portions of which may be briefly summarized as follows:

U.S. Pat. No. 4,016,783 to Spector et al., issued Apr. 12, 1977, discloses a wrench designed for screwing a polished angle valve or similar plumbing fitting without leaving unsightly teeth marks on it. The wrench is particularly suited for the installation of threaded angle-stops as were commonly used in the 1970's.

U.S. Pat. No. 4,542,666 to White, issued Sep. 24, 1985, teaches a wrench for freeing or turning oval handles such as those often found on angle-stop valve and fittings.

In accordance with the present invention, there is provided a two-part wrench, comprising: a first member including a first wrenching head and an elongated, partially hollow handle extending therefrom, said first wrenching head being suitable for holding a mechanical device having a plurality of generally flat sides intersecting at a plurality of corners; and a second member including a second wrenching head and an elongated handle extending therefrom, said second wrenching head being suitable for holding a mechanical device having a plurality of generally flat sides intersecting at a plurality of corners, wherein the elongated handle of the second member is suitable for slidable insertion, along a longitudinal direction, within the hollow handle of the first member, and wherein the first and second members each include complimentary mating means so as to allow the temporary connection of the first and second members when the elongated handle of the second member is inserted within the hollow handle of the first member.

In accordance with another aspect of the present invention, there is provided a two-part wrench, comprising: a first member including an open-end wrenching head and an elongated, hollow handle extending therefrom; and a second member including a split-box wrenching head and an elongated handle extending therefrom, wherein the elongated handle of the second member is suitable for slidable insertion, along a longitudinal direction, within the hollow handle of the first member, and wherein the first and second members each include complimentary mating means so as to allow the temporary connection of the first and second members when the elongated handle of the second member is inserted within the hollow handle of the first member.

In accordance with yet another aspect of the present invention, there is provided a wrench, comprising: a wrenching head suitable for holding a mechanical device having a plurality of generally flat, parallel sides; an elongated handle attached to and extending from said wrenching head; and a lug, said lug extending longitudinally from an end of the elongated handle opposite the wrenching head, said lug being of a certain cross-section and of a diameter suitable to engaging an inner surface of a mechanical device having the certain or compatible cross-section.

In accordance with yet a further aspect of the present invention, there is provided a method for installing a compression fit plumbing device, comprising the steps of: using a first wrench member, the first wrench member including a split-box wrenching head, an elongated handle, and a lug located on an end of the handle opposite the wrenching head, inserting the lug of the first wrench member into a riser mouth of the device, thereby gripping the device, and aligning the device on the end of a malleable supply pipe; using a second wrenching member, the second wrenching member including an open-end wrenching head and elongated handle, tightening a compression nut so as to affix the device to the supply line; inserting a riser line into the riser mouth of the device; and using the split-box wrenching head of the first wrench member, tightening a second compression nut about the riser line.

One aspect of the invention deals with a basic problem in the plumbing industry—installation of angle-stop and similar compression fittings in an enclosed, limited-access space. This aspect is further based on the discovery of a technique that alleviates this problem. The technique utilizes a two-piece tool that incorporates features not found in other tools or techniques. For example, the two-piece tool is separable into its two component members when being used, but may be reassembled for storage and use on other fittings or mechanical devices. When separated, the tool not only provides various "wrenching" surfaces for turning and/or holding components of an angle-stop fitting, but also provides features that facilitate the accurate positioning and alignment of the fitting with its associated fixture.

One aspect of the invention is based on the observation of problems with conventional wrenches and techniques used for the installation of such fittings. Often the tools used will result in the marring of the outer surface of the fitting, or will require that significant time be expended adjusting a wrench, searching for the correctly sized wrench, or re-adjusting the orientation or position of the fitting after it is first installed. The present invention overcomes the positioning problem by incorporating a lug-like feature on the end of one of the members so as to allow for accurate positioning of the fitting during installation, rather than readjustment.

The technique and apparatus described herein is advantageous because it is a single tool that provides the functionality of multiple conventional tools required for the installation of angle-stops and similar compression fittings. It also makes it unnecessary to have multiple wrenches for the installation of the compression fittings. As a result of the invention, plumbers and do-it-yourselfers will be able to easily install compression-type fittings in a reduced amount of time without marring the fitting, and will avoid the necessity of storing and carrying multiple tools.

Figure 1:
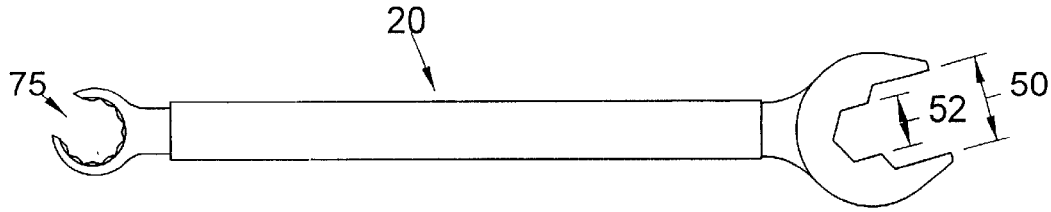
FIGS. 1–4 are orthogonal views of the present invention depicting the overall and specific details thereof.

The present invention will be described in connection with a preferred embodiment; however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been used throughout to designate identical elements. In describing the present invention, the following term(s) have been used in the description.

Figure 7:
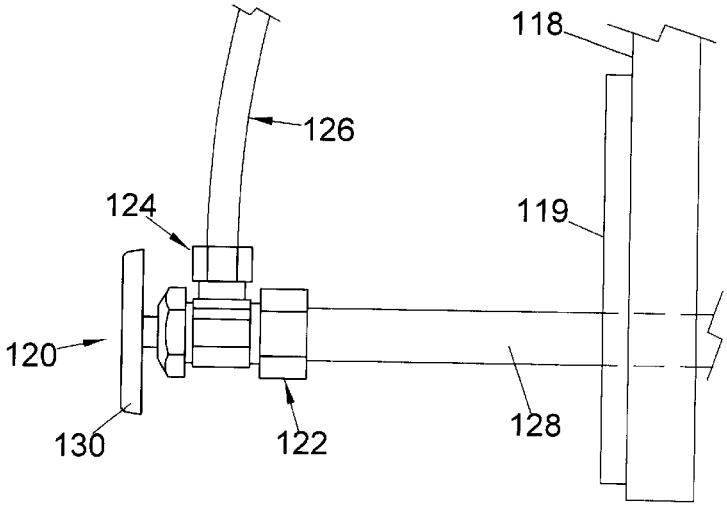
FIG. 7 is schematic illustration of a typical angle-stop installation.

Referring briefly to FIG. 7, the terms "compression stop," "compression valve" and "angle-stop" are generally used herein to characterize a plumbing fitting that connects to a water supply system to provide a shut-off for an associated plumbing fixture. The configuration of the fitting is often as illustrated by angle-stop 120 in FIG. 7. Each of the fittings has at least one compression component wherein a ferrule (not shown) and compression nut (e.g., primary nut 122 and riser nut 124) are employed to assure a watertight connection between the fitting and tubing 126 or pipe 128 to which it is connected. Such fittings also have a valve handle 130 or other mechanism by which a user can stop the supply of liquid to the riser tube 126.

The term "lug" has been employed herein to represent an element or aspect of the tool that protrudes therefrom and is of a size and shape as to fit within a riser or other opening of a plumbing fitting for which it is designed. The lug may be set off from the remainder of the tool by a shoulder or similar feature, and the shoulder may serve to limit the distance that the lug may be inserted into a receiving member. However, use of the term lug in the following description and appended claims is intended to include elements or aspects of the tool that protrude therefrom and fit into an opening of the fitting, whether or not set off by a shoulder.

Figure 2:
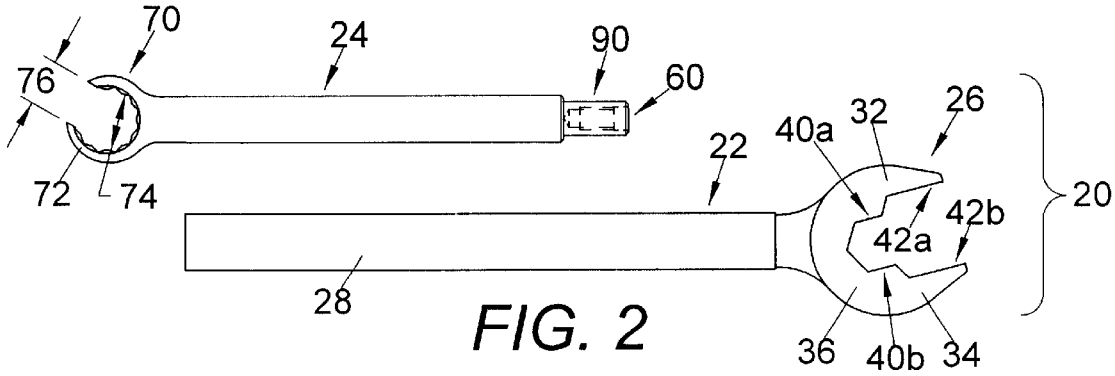
Figure 3:
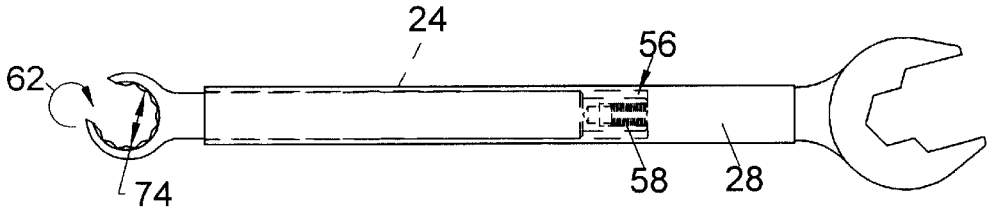

Referring now to FIGS. 1 and 2, there are depicted assembled and disassembled external views of the present two-piece wrench 20. The wrench 20 includes a first member 22 and a second member 24, both of which are preferably formed from a rigid metal alloy (cast, forged, rolled, extruded, etc.), a sintered powdered material, high-strength plastic or similar material with properties making it suitable for use as a tool. First member 22 includes a wrenching head 26 and an elongated, hollow handle 28. The wrenching head 26 includes a pair of jaws 32 and 34 and a throat 36 interconnecting the jaws. The throat 36 preferably has a curved outer surface that not only connects the two jaws, but also provides for a transition to the elongated handle 28 in the embodiment shown. The first jaw 32 has at least one, and preferably two, non-coplanar, parallel jaw surfaces 40*a* and 42*a* and the second jaw 34 has at least one, and preferably two corresponding non-coplanar, parallel jaw surfaces 40*b* and 42*b*.

As shown in FIG. 1, defined between jaw surfaces 42*a* and 42*b* is a first wrenching span 50, respectively defined by the first and second planar jaw surfaces that are substantially parallel to each other. The surfaces are preferably spaced apart a distance slightly greater than the minimum dimension of the mechanical device that the wrenching head is intended to accommodate. Similarly, defined between a second set of jaw surfaces 40*a* and 40*b* is a second wrenching span 52, respectively defined by the jaw surfaces 40*a* and 40*b* that are substantially parallel to each other. The surfaces defining the second wrenching span are preferably spaced apart a distance slightly greater than the minimum dimension of a second mechanical device that the wrenching head is intended to accommodate.

As shown in FIG. 2, member 24 also includes a wrenching head 70. The wrenching head is of a design characterized as a split-box wrench. The split-box wrench head 70 comprises a multi-point box head 72 for engaging a mechanical device having a minimum diameter of a size indicated by arrow 74, where the minimum diameter is suitable for wrenching a device with an approximately ⅝ inch (16 mm) or 13⁄16 inch (20.64 mm) diameter. The split-box wrench head also has a split or aperture 75 therein. The aperture is of a size, indicated by reference arrow 76, sufficient to allow wrench head 70 to pass around the outer perimeter of a pipe having an outside diameter smaller than the first minimum diameter, preferably about a ½ inch (12.7 mm) diameter. The split-box wrench is preferably a well-known 12-point design, suitable for engaging and wrenching hexagonal fittings, whereas the aperture is intended to accommodate the wrench head being used to tighten or loosen a compression nut such as nut 124 in FIG. 8.

Figure 5:
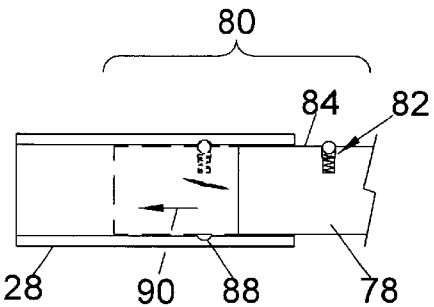

Yet another alternative for the mating means 56 would be the ball and detent mechanism shown in FIG. 5. Such a mechanism, commonly used to temporarily connect socket wrench heads to socket-wrench handles, would serve to connect the two members of wrench 20. More specifically, the alternative mating means 80 includes a spring-loaded ball 82 that protrudes from an outer surface 84 of the handle 78 of the second member, and a ring-shaped detent 88 on an inner surface of the hollow handle 28. Insertion of the handle of the second member into the hollow handle of the first member (as shown by reference arrow 90) will enable the spring-loaded ball to engage the detent and temporarily connect said first and second members.

Figure 6:
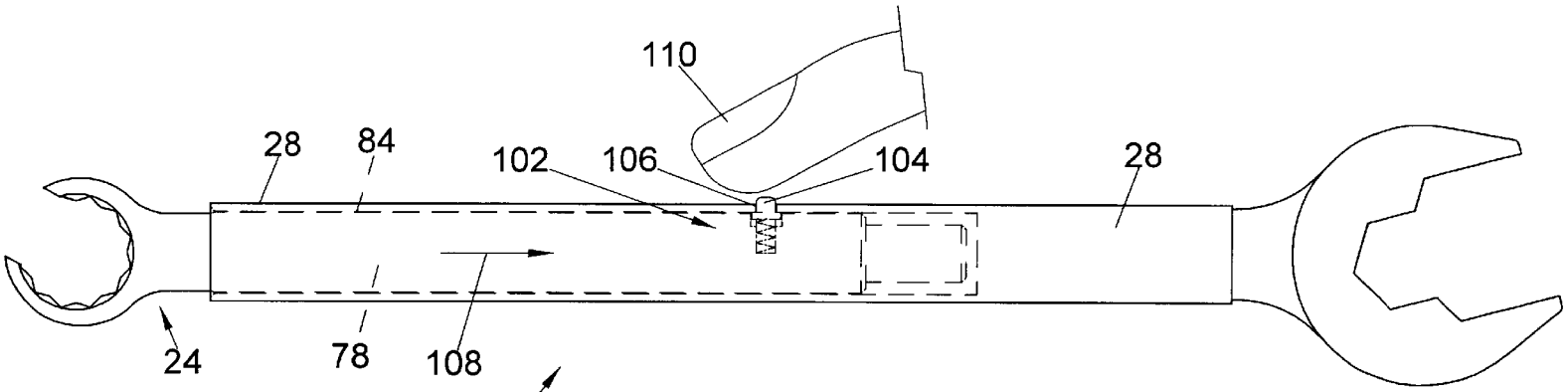
FIGS. 5 and 6 are detailed views of alternative complimentary mating means.
Figure 6A:
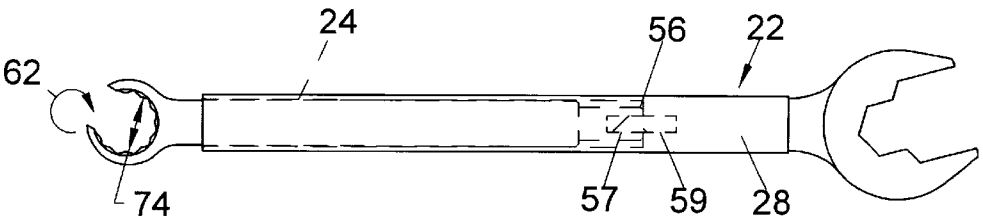
FIG. 6*a* is a detailed view of still another alternative complimentary mating means.

A further alternative for the mating means 56 would be the spring-loaded button mechanism 102 shown in FIG. 6. Such a mechanism, commonly used to temporarily connect slidable tubes, would serve to connect the two members of wrench 20. More specifically, the alternative mating means 102 includes a spring-loaded button 104 that protrudes from an outer surface 84 of the handle 78 of the second member, and a circular hole or aperture 106 through the hollow handle 28. Insertion of the handle of the second member into the hollow handle of the first member (in the direction of reference arrow 108) will enable the spring-loaded button to engage the hole 106 and temporarily connect said first and second members. To release the connection, a user pushes the button down with a finger 110 or thumb to depress the button at the same time as the wrench members are drawn apart.

Figure 4:
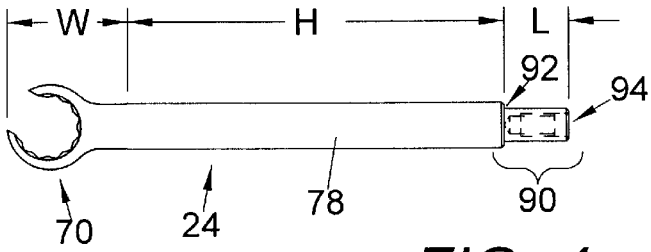

Referring now to FIG. 4, second member 24 has a further unique feature at the end of the handle opposite the wrench head. In particular, a lug, generally indicated by reference numeral 90, is machined into the end of the handle. The lug includes a shoulder 92 and a reduced diameter section 94. Lug 90 is purposely designed to fit within the inside diameter of a compression fitting such as fitting 120 in FIG. 8 as is more specifically illustrated in FIG. 9. Although the shoulder, or upper end of the lug may limit the distance the lug may be inserted, the lug preferably reaches an internal shoulder (not shown) of the stop which blocks further entry, and leaves approximately 1⁄16" of the lug extending above the stop mouth. Returning to FIG. 4, member 24 preferably includes a wrenching head 70 with an overall length W (about 1.25 inches) connected to a handle 78 that extends a distance H (about 5 inches) from the wrenching head, and a lug 90 that further extends in a longitudinal direction a distance L (about ½ inch) from the wrench handle. In a preferred embodiment, the outer edge of lug 90, and the edge of the handle at shoulder 92 are radiused or broken so as to make it easier to insert the lug into the plumbing fitting, and to make it easier to re-insert the lug end of handle 78 into the hollow handle of member 28. It will be appreciated that the diameter of the lug is preferably designed in accordance with the inner diameter of the riser opening on the fitting.

Figure 8:
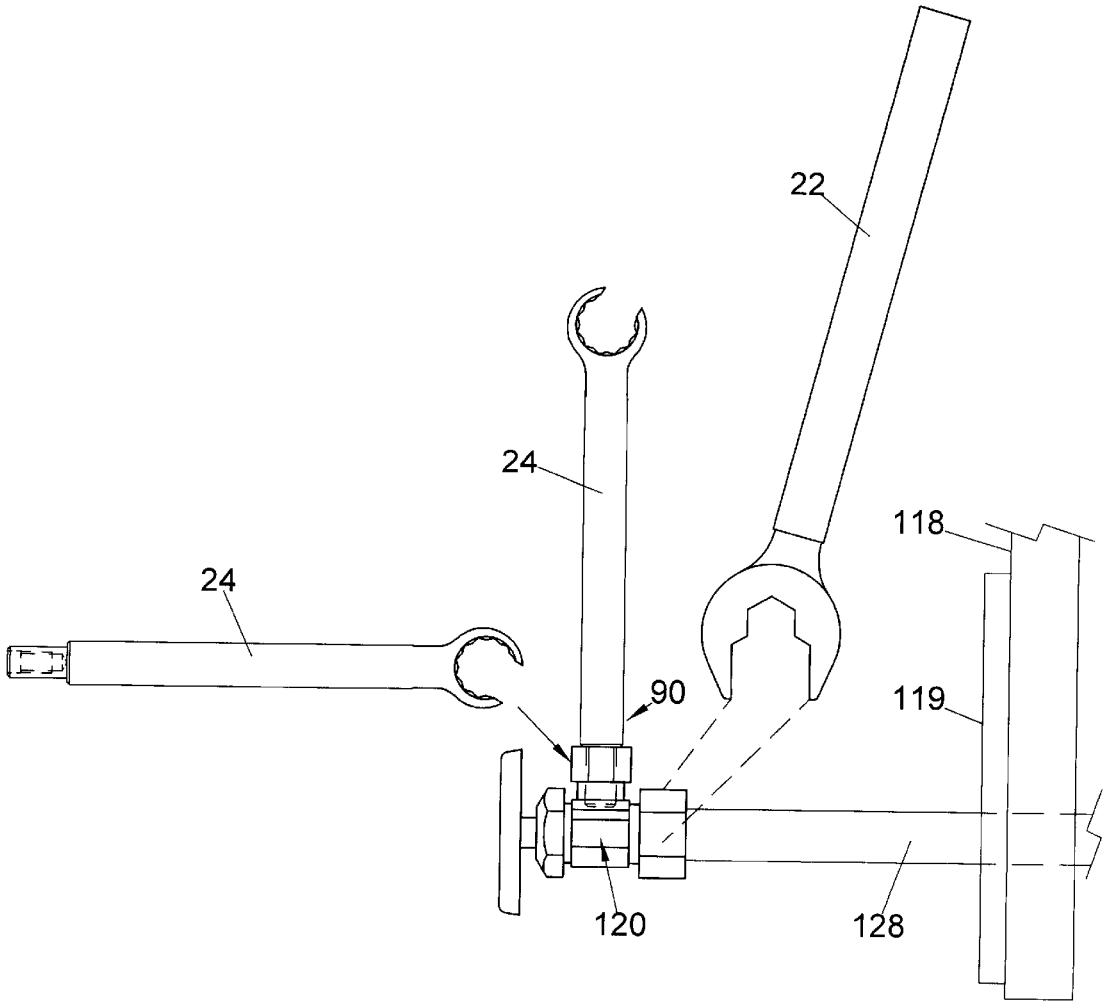
FIG. 8 is a schematic diagram illustrating use of the various features of the present invention for installation of a compression-type fitting.

Referring now to FIG. 8, the illustration is intended to depict the various functions that the wrench 20 is intended to accomplish. In order to use the wrench 20 in accordance with the present invention, the angle-stop 120 is first loosely placed onto the outside of supply pipe 128 that protrudes from a wall 118 or cabinet back 119. Once loosely fitted, the lug end 90 of second member 24 is inserted into the riser mouth of the stop, the opening intended for a compression fit with the riser tubing (126 in FIG. 7). In this fashion, second member 24 may be used to not only steady the stop 120 against rotation, while the compression connection to pipe 110 is tightened by a wrenching operation with first member 22, but also to align the riser opening with the fixture/faucet supply tube it is intended to be connected to. In contrast, when such installations are attempted by "feel" with an angled automotive or crescent wrench, the angle at which the stop is left pointing often deviates from a preferred orientation or position for mating with the supply tubing from the faucet above. This condition is eliminated by the "feel" and/or "visualization" enabled by the combination of the lug, and the handle of the second member which projects the angle via the handle, allowing the optimum angle to be easily perceived by the installer.

Once correctly aligned and tightened, the lug end of the second member 24 is removed from the stop, the compression nut 124 and riser tubing 126 installed, and then the wrench head of member 24 employed to tighten the compression nut for the riser. Here, again, the advantage of the split-box wrench head being apparent, as there is no need to completely remove the wrench from the compression nut each time a new wrench surface is required to further advance the compression nut. The user simply tightens, lifts, and returns the wrench head to accomplish an almost ratchet-like tightening of the compression nut.

Figure 9:
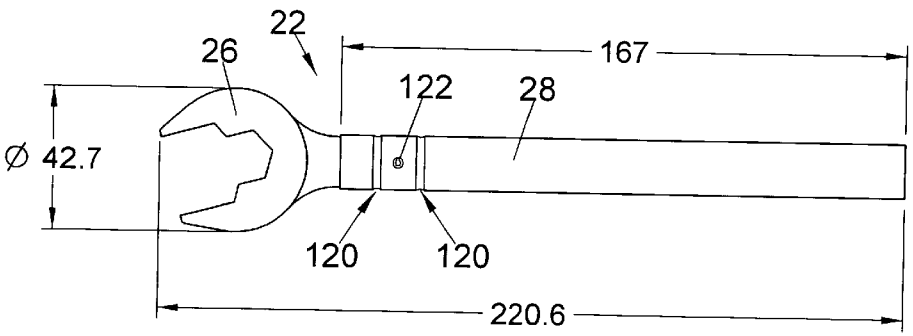
FIGS. 9–12 are orthographic illustrations of the as-manufactured assemblies that comprise the members of the present invention.
Figure 10:
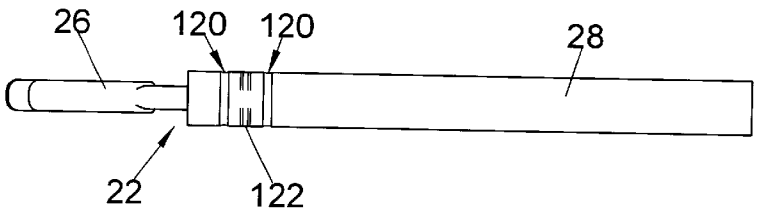

Having described the various aspects of preferred embodiments of the present invention, attention is now turned to the manufacture of the present invention. Referring to FIGS. 9–12, there are illustrated the basic assemblies of the two wrench members made in accordance with a preferred process of manufacture. In particular, FIGS. 9 and 10 illustrate two views of the first member 2 with handle 28. Wrench head 26 is permanently connected to handle 26 by any of a number of fastening processes, including but not limited to welding, mechanical connection, soldering, gluing, etc. Preferably, as illustrated in the figures, a round end of the wrench head is inserted into an open end of handle 28 and the outer surface of handle 28 receives a 360 degree crimp, as represented by parallel grooves 120 to provide rigid mating connection therebetween. To prevent relative "twisting" motion between the handle and the wrench head, a permanent spring pin 122 may also be inserted through the handle 28 and into the wrench head 26. Spring pin 122 is of a type that is compressed and inserted into a drilled or punched hole, where it expands to provide an interlocking connection between the handle and the wrench head. Alternatively, the handle 28 and wrench head 26 may be friction welded to one another using a slight compression fit.

Figure 11:
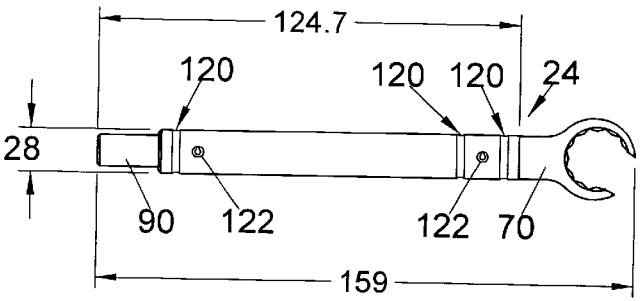
Figure 12:
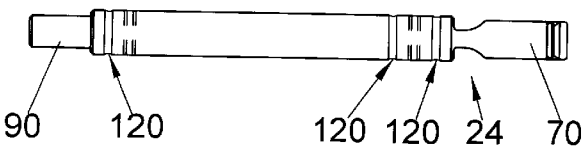

In a preferred embodiment, the components of the second member (wrench head, handle and lug) are forged or cast as a single element from one of a plurality of metal alloys. Alternatively, as depicted in FIGS. 11 and 12, the wrench head 70 and lug 90 of second member 24 may also be interconnected with a section of hollow tubing, and both ends are treated in a similar manner using 360-degree crimping (grooves 120) and spring pins 122 to add rigidity and to prevent twisting of one part relative to the other. Although not shown, it is further understood that the outer surfaces of each tool member may have a non-slip surface treatment (e.g., sand-blasting, knurling, painting or electroplating) applied thereto so as to improve a user's ability to grasp the tools.

In recapitulation, the present invention is an apparatus that may be employed in the installation of compression valves or stops and their associated compression couplings. To overcome difficulties with the installation of compression and anglestop devices, the two-piece apparatus enables the installation of a compression stop plumbing fitting, or similar mechanical device, without the need for any additional tools. In particular the end of one piece of the apparatus, when separated, allows the installer to grip the fitting on an interior surface so as to aid in aligning and tightenting the compression fitting without marring outer surfaces thereof. Moreover, various features of the present invention facilitate the installation of such fittings in inaccessible areas.

It is, therefore, apparent that there has been provided, in accordance with the present invention, a two-piece apparatus for the installation of compression-type plumbing fittings. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A two-part wrench, comprising:

a first member including a first wrenching head and an elongated, partially hollow handle, having a longitudinal axis, extending therefrom, said first wrenching head being suitable for engaging hexagonally shaped plumbing nuts and fittings having a plurality of parallel spaced apart generally flat sides intersecting at a plurality of corners; and a second member including a second wrenching head and an elongated handle, having a longitudinal axis extending therefrom, said second wrenching head being suitable for hexagonally shaped plumbing nuts, having a plurality of generally flat sides intersecting at a plurality of corners;

wherein said elongated handle of said second member is suitable for slidable insertion, along the longitudinal axis, within said partially hollow handle of said first member, and wherein said first and second members each include complimentary mating means so as to allow the temporary connection of said first and second members when said elongated handle of said second member is inserted within said partially hollow handle of said first member, said complimentary mating means for temporarily connecting the first and second members including:

a threaded member extending from said first wrenching head along the longitudinal axis of said partially hollow handle of said first member and within said hollow handle; and said handle of said second member having an end spaced from said second wrenching head, a tapped hole at said end of said handle of said second member, said hole extending longitudinally along the longitudinal axis of said handle, wherein the insertion of said handle of said second member into said partially hollow handle of said first member and the rotation of said first member relative to said second member causes the engagement of said threaded member with said tapped hole so as to temporarily connect said first and second members.

2. The two-part wrench of claim 1, wherein said first wrenching head includes:

a first jaw;

a second jaw; and a throat interconnecting said jaws, wherein said first and second jaws respectively define first and second planar jaw surfaces substantially parallel to each other and spaced apart a distance slightly greater than the distance between parallel surfaces of the hexagonally shaped plumbing nuts and fittings.

3. The two-part wrench of claim 1, wherein said first wrenching head includes:

a first jaw;

a second jaw; and a throat interconnecting said jaws, wherein said first and second jaws each further include at least two planar jaw surfaces arranged in a non-coplanar, parallel manner so that the planar jaw surfaces on each of the first and second jaws define at least first and second pairs of wrenching surfaces therebetween, and where said first pair of wrenching surfaces is spaced apart a first distance slightly greater than the distance between parallel surfaces of a first hexagonally shaped plumbing nut or fitting and where said second pair of wrenching surfaces is spaced apart a second distance, smaller than the first distance and slightly greater than the distance between parallel surfaces of a second hexagonally shaped plumbing nut or fitting.

4. The two-part wrench of claim 3, wherein said first pair of wrenching surfaces define a wrenching span of about 15/16 inches (23.81 mm) and where the second pair of wrenching surfaces define a wrenching span of about 9/16 inches (14.29 mm).

5. The two-part wrench of claim 3, wherein said first pair of wrenching surfaces define a wrenching span of at least 15/16 inches (23.81 mm) and where said second pair of wrenching surfaces define a wrenching span of at least 9/16 inches (14.29 mm).

6. The two-part wrench of claim 1, wherein said elongated handle of said second member has an end spaced from said second wrenching head, said second member further includes a lug, extending longitudinally from said end, said lug being of a certain cross-section and of a size suitable for engaging an inner surface of a plumbing fitting having the same certain cross-section.

7. The two-part wrench of claim 1, wherein at least one of said wrenching heads comprises a split-box wrench.

8. The two-part wrench of claim 7, wherein said split-box wrench, includes:

a multi-point box head for engaging a hexagonally shaped plumbing nut; and an aperture therein, wherein the aperture is of a size sufficient to allow said multi-point box head to pass around a pipe having an outside diameter smaller than the spacing between the parallel surfaces of the hexagonally shaped plumbing nut.

9. The two-part wrench of claim 8, wherein said multi-point box head is a twelve point design suitable for wrenching a hexagonally shaped plumbing nut having parallel sides spaced apart by approximately ⅜ inches (16 mm), and where the size of the aperture is about one-half inch (12.7 mm).

10. The two-part wrench of claim 8, wherein said multi-point box head is a twelve point design suitable for wrenching a hexagonally shaped plumbing nut having parallel sides spaced apart by approximately 13⁄16 inches (20.64 mm), and where the size of the aperture is about one-half inch (12.7 mm).

11. A two-part wrench, comprising:

a first member including an open-end wrenching head and an elongated, hollow handle, having a longitudinal axis extending therefrom; and a second member including a split-box wrenching head and an elongated handle, having a longitudinal axis extending therefrom, wherein said elongated handle of said second member is suitable for slidable insertion, along the longitudinal axis, within said hollow handle of said first member, and wherein said first and second members each include complimentary mating means so as to allow the temporary connection of said first and second members when said elongated handle of said second member is inserted within said hollow handle of said first member, said complimentary mating means for temporarily connecting the first and second members includes:

a threaded member extending from the first wrenching head along the longitudinal axis of the hollow handle of said first member and within the hollow handle; and a tapped hole at an end of the handle of the second member opposite the wrenching head, said hole extending longitudinally along the longitudinal axis of the handle, wherein the insertion of the handle of the second member into the hollow handle of the first member and the rotation of the first member relative to the second member causes the engagement of the threaded member with the tapped hole so as to temporarily connect said first and second members.

12. The two-part wrench of claim 1, wherein at least one of said wrench heads is a split-box wrench head having twelve points suitable for wrenching a hexagonally shaped plumbing nut.

13. The two-part wrench of claim 11, wherein said split-box wrench is a twelve point design suitable for wrenching a hexagonally shaped plumbing nut.

* * * * *

UNITED STATES PATENT AND TRADEMARK OFFICE

CERTIFICATE OF CORRECTION

PATENT NO. : 6,523,440 B2 
DATED : February 25, 2003
INVENTOR(S) : David F. Friedman and Harry C. Friedman It is certified that error appears in the above-identified patent and that said Letters Patent is hereby corrected as shown below:

Title page,
Item [73], Assignee, change "Teel" to -- Tool --.

Signed and Sealed this

Fifth Day of August, 2003

JAMES E. ROGAN
*Director of the United States Patent and Trademark Office*